US011717743B2

(12) United States Patent
Becker

(10) Patent No.: US 11,717,743 B2
(45) Date of Patent: Aug. 8, 2023

(54) METHOD FOR PLAYING A SKILL-BASED STRATEGY GAME

(71) Applicant: Robert Becker, Glencoe, IL (US)

(72) Inventor: Robert Becker, Glencoe, IL (US)

( * ) Notice: Subject to any disclaimer, the term of this patent is extended or adjusted under 35 U.S.C. 154(b) by 310 days.

(21) Appl. No.: 17/095,496

(22) Filed: Nov. 11, 2020

(65) Prior Publication Data

US 2021/0146232 A1 May 20, 2021

Related U.S. Application Data

(60) Provisional application No. 62/937,196, filed on Nov. 18, 2019.

(51) Int. Cl.
*A63F 7/00* (2006.01)

(52) U.S. Cl.
CPC ..... *A63F 7/0023* (2013.01); *A63F 7/0076* (2013.01); *A63F 2007/0035* (2013.01); *A63F 2007/0041* (2013.01)

(58) Field of Classification Search
CPC ..... A63F 11/0074; A63F 7/00; A63F 7/0023; A63F 7/0076; A63F 2007/0035; A63F 2007/0041
See application file for complete search history.

(56) References Cited

U.S. PATENT DOCUMENTS

| | | | | | |
|---|---|---|---|---|---|
| 1,666,474 | A * | 4/1928 | Sorell | A63F 7/0076 | 273/108 |
| 4,103,894 | A * | 8/1978 | McCraw | A63F 7/0023 | 473/588 |
| 4,294,449 | A * | 10/1981 | Shaw | A63D 15/00 | 473/18 |
| 2015/0008644 | A1* | 1/2015 | Masching | A63F 7/0023 | 273/126 R |
| 2019/0160373 | A1* | 5/2019 | Near | A63F 7/0076 | |
| 2021/0146232 | A1* | 5/2021 | Becker | A63F 7/0076 | |

FOREIGN PATENT DOCUMENTS

| | | | | | |
|---|---|---|---|---|---|
| EP | 0766980 | A1 * | 4/1997 | A63F 3/00075 | |
| GB | 2125300 | A * | 3/1984 | A63F 3/00075 | |
| GB | 2257369 | A * | 1/1993 | A63F 7/0023 | |
| GB | 2341329 | A * | 3/2000 | A63F 7/0023 | |
| GB | 2392633 | A * | 3/2004 | A63F 7/0023 | |

* cited by examiner

*Primary Examiner* — Raleigh W Chiu
(74) *Attorney, Agent, or Firm* — Crowell & Moring LLP

(57) ABSTRACT

A method of playing a game includes commencing a building phase, which includes placing a plurality of first player barrier pieces and first player battle pieces, and at least one first player king piece in a first player fortress arrangement, and placing a plurality of second player barrier pieces and second player battle pieces, and at least one second player king piece in a second player fortress arrangement. The method further includes subsequently commencing a battle phase including propelling a first player battle piece toward the second player fortress arrangement, contacting the at least one second player king piece by the first player battle piece, and eliminating the second player king piece in response to being contacted.

19 Claims, 7 Drawing Sheets

METHOD FOR PLAYING A SKILL-BASED STRATEGY GAME

CROSS-REFERENCE TO RELATED APPLICATIONS

This application claims priority to U.S. Provisional Application No. 62/937,196, filed on Nov. 18, 2019, and titled "Skill Based Board Free Table Top Strategy Game," the entirety of which is hereby incorporated by reference herein.

FIELD OF THE INVENTION

The present disclosure relates to table games and methods of playing same.

BACKGROUND

People enjoy playing board games and table games as a form of entertainment and relaxation. Some games require strategy, forethought, and planning. Others games may utilize physical and dynamic action or kinetic motion of one or more game pieces. However, few table games utilize both aspects, requiring a player to employ both strategic thinking and planning combined with skilled physical movement of one or more game pieces.

DETAILED DESCRIPTION

Barrier Battles is a two or more player game where the players build fortresses 112 using Barrier Pieces 102 to protect a King Piece 106, and then flick Battle Pieces 104 to gain new position, knock down the enemy fortress 112, and eliminate enemy pieces through collision.

Barrier Battles entertains people by providing an interactive and fun game that's easy to learn. Barrier Battles strives to teach people problem solving skills and strategy in a competitive and satisfying way. Barrier Battles also provides entertainment for spectators of the game because battles can be intense and fun to watch.

Figure 1:
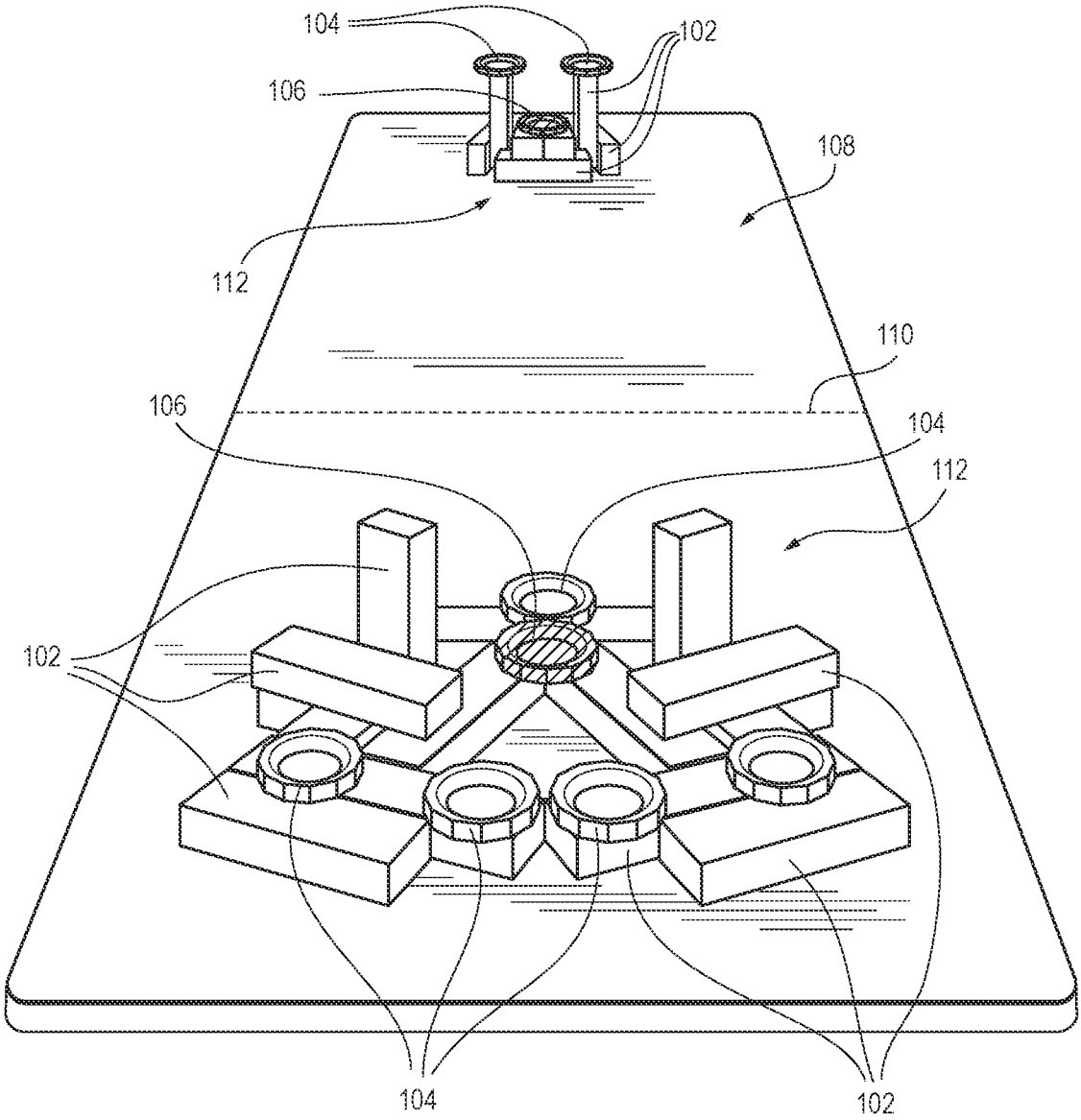
FIG. 1 illustrates an example game setup in accordance with various embodiments.

Barrier Battles preferably is a multi-player game. FIG. 1 illustrates a Barrier Battles game setup after the Building Phase but before the Battle Phase has begun. During the building phase, the two players build a fortress 112, for example, using 15 blocks in a different color from the other player, five disc pieces the same color as their blocks, and a differently colored disc piece. Their blocks are officially called "Barrier Pieces" 102 (see FIG. 4), and their disc pieces are officially called "Battle Pieces" 104 (see FIG. 5). Each player's disc piece of a unique color is officially called a "King Piece" 106. As shown in FIG. 1, as long as the players preferably keep their Barrier Pieces 102, Battle Pieces 104, and King Piece 106 on their half of the play area 108 set by the players (e.g., set, at least in part by boundary 110), the players can build their fortress 112 in any way they choose. In the example of FIG. 1, the players have built their bases 112 in unique ways.

In various embodiments, the game involves a Barrier Battles set and a smooth surface on which to play (e.g., play area 108). The surface may be a table top or a board that can be folded for easy transportation, for example, a box container that holds all the pieces but when opened can be the playing surface. In a two player embodiment, before the game begins, the players may set the play area 108 and divide it in two. For example, when playing on a table, the play area 108 may be the table top. When on a board, the play area 108 set by the players may be the board. Sometimes, however, when the game is played on a large table or the floor, the players may set other boundaries 110 to limit the space of the game. After the boundaries 110 are set, one player takes, for example, 15 Barrier Pieces 102 (see FIG. 4) of one color, five Battle Pieces 104 of one color, and one King Piece 106 (see FIG. 5) while the other player takes identical Barrier Pieces 102, Battle Pieces 104, and a King Piece 106 of different colors, but in the same number.

Figure 2:
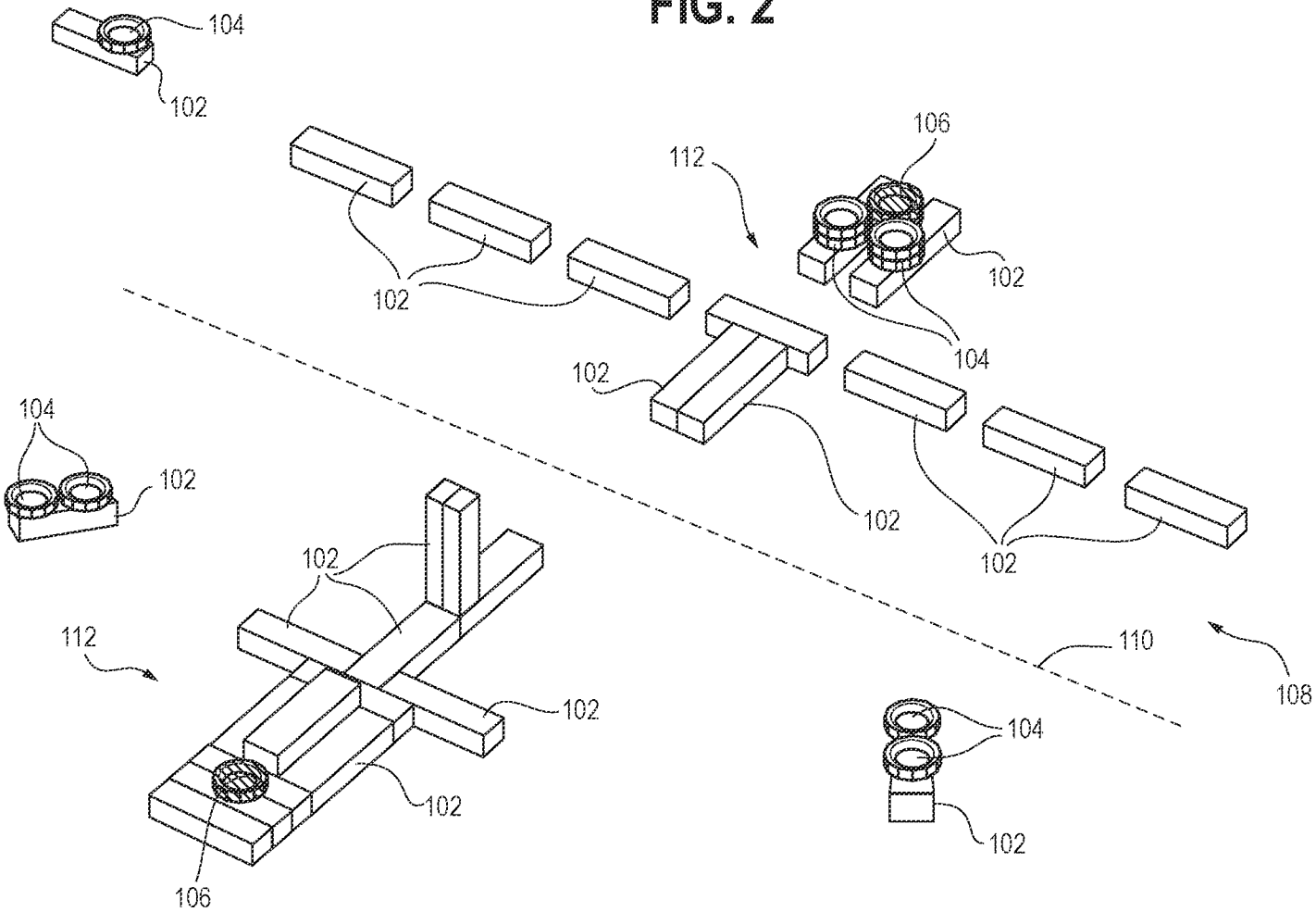
FIG. 2 illustrates another example game setup in accordance with various embodiments.

FIG. 2 illustrates another example of a Barrier Battles game after the building phase, where both sides have used their Barrier Pieces 102 and Battle Pieces 104 to make bases 112 in unique and interesting ways. In various approaches, the players can place their pieces in any position as long as they stay on their portion of the playing surface 108, such as a table or board. Once both players finish the building phase, the players may begin the battle phase and take turns flicking their Battle Pieces 104 or King Piece 106. In one example, the player who finished building during the building phase first may take their turn first during the battle phase. In various examples, each player may only flick one of their Battle Pieces 104 or their King Piece 106 before the next player flicks one of their Battle Pieces 104 or King Piece 106. In some approaches, no player may flick any Battle Piece 104 or King Piece 106 before all pieces in the game come to rest and cease to be in motion. In accordance with some embodiments, no player may directly flick a Barrier Piece 102, and players flick the Battle Pieces 104 or King Piece 106 of their color(s) they used during the building phase. For example, the players choose these pieces before the building phase begins, and the Battle Pieces 104 may match the color of the Barrier Pieces 102.

Barrier Battles sets can come in a wide variety of colors, and one half of the Barrier Pieces 102 and Battle Pieces 104 may match. The half of Barrier Pieces 102 and Battle Pieces 104 that match may be distinguishable in color from the other half of Barrier Pieces 102 and Battle Pieces 104, which may match in a different color. In certain examples, each King Piece 106 may each have a distinct color from the other Barrier Pieces 102 and Battle Pieces 104 in that set of Barrier Battles. In certain examples, a Barrier Battles set may have red and blue Barrier Pieces 102, red and blue Battle Pieces 104, and a purple King Piece 106 and an orange King Piece 106. This means, in one example, one player may use 15 red Barrier Pieces 102, five red Battle Pieces 104, and an orange or purple King Piece 106, while the other player may use 15 blue Barrier Pieces 102, five blue Battle Pieces 104, and another King Piece 106. Many other color combinations are possible, and the embodiments are not limited to these examples.

Figure 3:
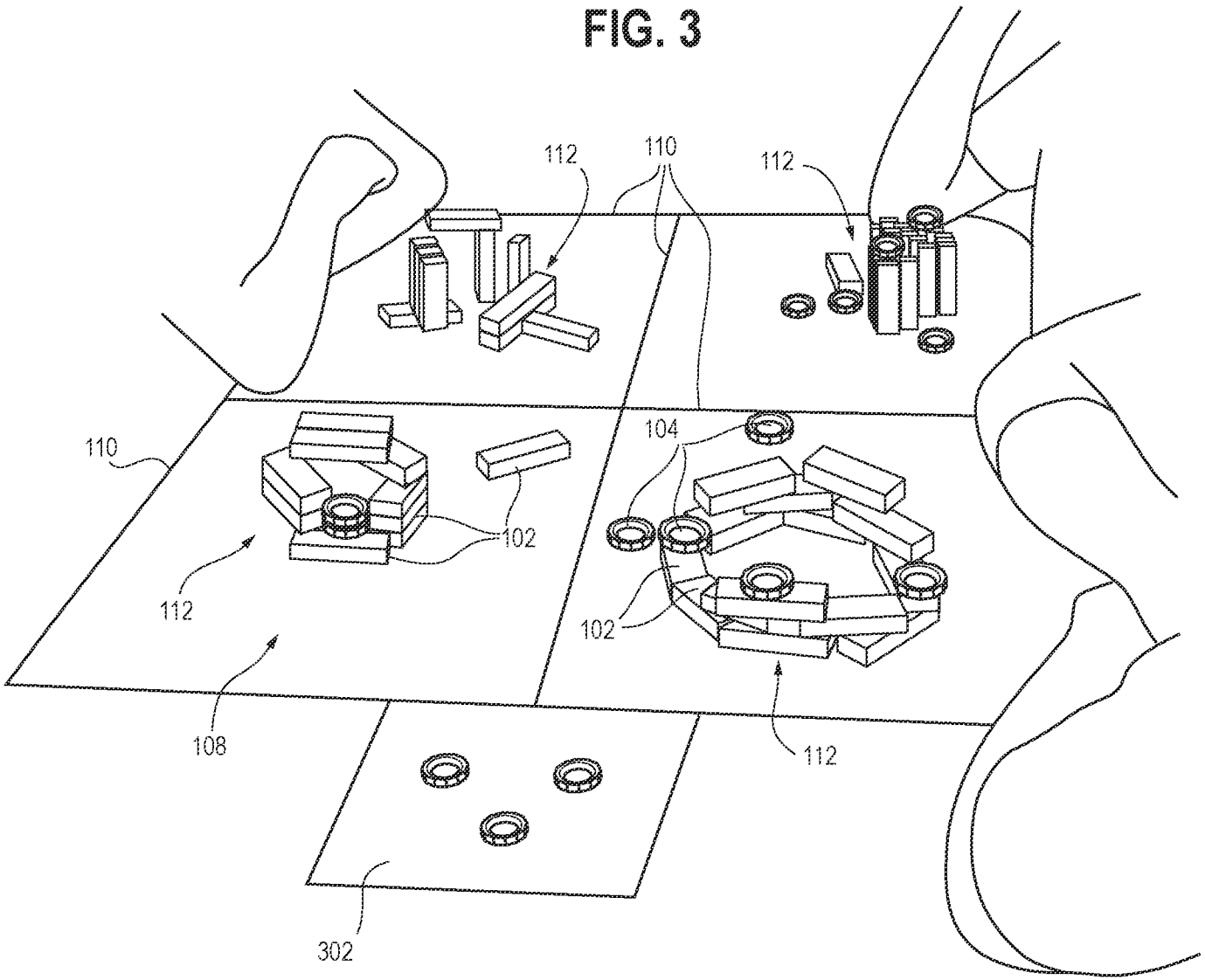
FIG. 3 illustrates an example game setup involving four players in accordance with various embodiments.

FIG. 3 illustrates an example four player game where all players have built their bases 112 using uniquely colored Barrier Pieces 102 and Battle Pieces 104, and are now engaged in the battle phase. During the battle phase, the players will take turns flicking their pieces to move position, disrupt enemy bases 112, or eliminate enemy pieces through direct collision. In one example, the Battle Pieces 104 in the smallest drawn box 302 are Battle Pieces 104 that were eliminated during the battle phase, which means they were removed from play. In various embodiments, Battle Pieces 104 may be eliminated in two ways. First, if the Battle Piece 104 is touched by an enemy Battle Piece 104 during the turn of that enemy Battle Piece 104, then the Battle Piece 104 is eliminated. A common way an enemy Battle Piece 104 touches a Battle Piece 104 of another player is because the enemy player flicks an enemy Battle Piece 104 directly into a Battle Piece 104 of another player. A second way a Battle Piece 104 may be eliminated is because it leaves the designated play area 108. A common way a Battle Piece 104 leaves the designated play area 108 is because a player flicks their own Battle Piece 104 outside of the designated play area 108 by accident. In various approaches, eliminated Battle Pieces 104 are removed from play and cannot affect the game in any way for the rest of the game.

Barrier Battles may be played with as many people as desired. For example, when four people play, four Barrier Battles subsets of, for example, 15 Barrier Pieces 102, five Battle Pieces 104, and one King Piece 106 are used, one set for each player. Barrier Battles sets may have two of these subsets of 15 Barrier Pieces 102, five Battle Pieces 104, and a King Piece 106. However, Barrier Battles may come in more or less of these subsets (or different subsets) to accommodate different numbers of players. In the case of four players, the playing surface may be divided into four quadrants and each player may build in their quadrant. The playing surface may be a square, or can be any other shape including for example, a rectangle, a circle, or any other geometric shape. In games with more than two players, alliances can be made and betrayed.

Figure 4:
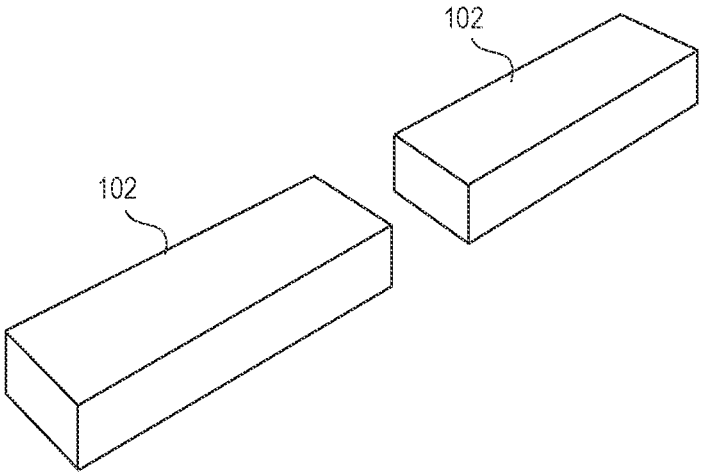
FIG. 4 illustrates example barrier pieces in accordance with various embodiments.

FIG. 4 illustrates an example of Barrier Pieces 102 in accordance with various embodiments. In various approaches, the Barrier Pieces 102 resemble rectangular blocks. The Barrier Pieces 102 are used to create fortresses 112 in Barrier Battles during the building phase. A Barrier Battles kit may come with, for example, 30 Barrier Pieces 102, 15 of one color variant and 15 of another color variant. Barrier Pieces 102 may be rectangular prisms. In one specific example, they are rectangular prisms with dimensions of 0.6 inches by 1 inch by 3 inches. A Barrier Battles Barrier Piece 102 may have at least one flat side to accommodate building the fortress 112. For a similar reason, a Battle Piece 104 preferably should have at least one substantially flat side to accommodate placing it during the building phase. In some embodiments, a textured, knurled or other patterned side can be used as it will allow for the building phase, even if it is not completely flat. On each team, Battle Pieces 104 and Barrier Pieces 102 of the same team may have the same color with the exception of the King Pieces 106 which may be a different color.

The players may use their Barrier Pieces 102 and Battle Pieces 104 to construct a fortress 112 on their half of the play area 108 in any way they want. In certain approaches, the players cannot build onto another player's area, nor build outside the boundaries 110 set by the players. The player can use their Barrier Pieces 102 to build up or across the expanse of their half, and they can build ramps or rams or an assortment of other strategic formations. The players preferably can use their Barrier Pieces 102 and Battle Pieces 104 to construct a base 112. Barrier Battles blocks can be used to build fortresses 112 to protect and aid Battle Pieces 104 and the King Piece 106. In various embodiments, Barrier Pieces 102 cannot be directly flicked after the building phase. However, Barrier Pieces 102 can be moved by either enemy or allied Battle Pieces 104 which can contact or impact the allied Battle Pieces 104 to move the Barrier Pieces 102 across the play area 108. In accordance with various embodiments, unlike Battle Pieces 104, Barrier Pieces 102 cannot be eliminated through contact alone with enemy Battle Pieces 104, but they are removed from play when they leave the designated play area 108.

Figure 5:
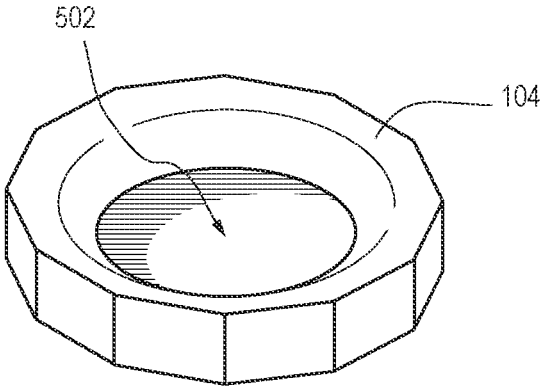
FIG. 5 illustrates an example battle piece in accordance with various embodiments.

FIG. 5 illustrates an example Battle Piece 104 in accordance with various embodiments. In one example, it is a 12-sided disc with a large concave depression 502 in the middle. In a particular example, the Battle Piece 104 may have a height from the lowest point to the highest point of 0.313 inches, and the height from the bottom of the depression 502 to the top of the depression 502 may be 0.113 inches. In a particular example, a distance between the top of the piece 104 to the top of the depression 502 may be, 0.2 inches, and a diameter of the whole disc may be 1.4 inches, while the diameter of the inner circle of the depression 502 may be 0.856 inches. There may be a 0.272 inch in length gap between the side of the piece 104 and the top of the depression 502. Different geometric shapes, such as squares, rectangles, or triangles, can also be used as Battle Pieces 104 as long as they are capable of being flicked or otherwise used by the player. In certain examples, a Barrier Battles set contains 12 pieces of this shape and dimension, where five the pieces are Battle Pieces 104 that are of one color variant, while five other pieces are Battle Pieces 104 that are of another color variant. Two additional pieces of two additional color variants may be the King Pieces 106.

Figure 6:
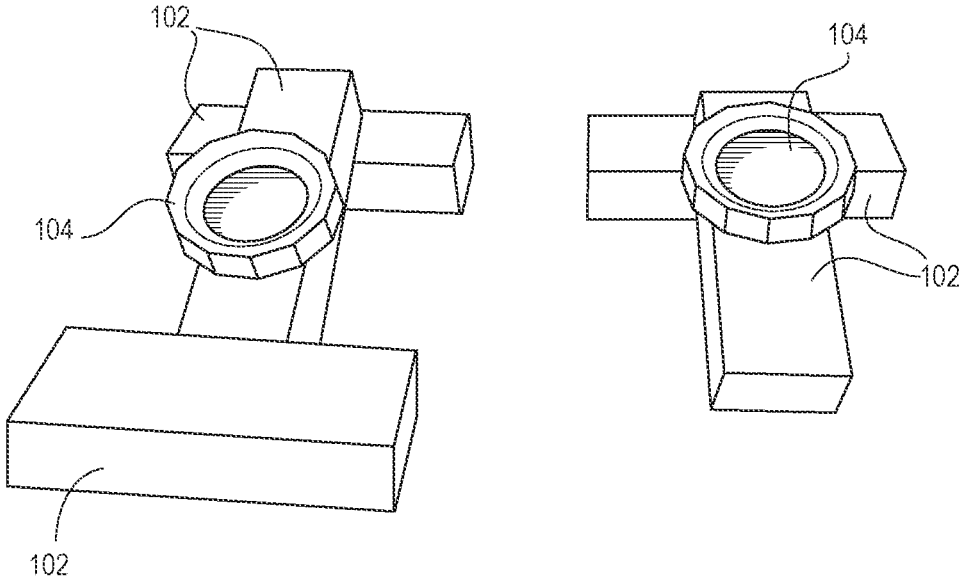
FIG. 6 illustrates an example game piece setup in accordance with various embodiments.

FIG. 6 illustrates an example game piece setup in accordance with various embodiments. Here, an example strategy setup players use called a "cannon" is illustrated, which may be one of the many strategies players can use based off of the Barrier Battles rule set. During the building phase of the game, players have the ability to set their Barrier Pieces 102 and Battle Pieces 104 in any way they choose as long as they stay on their side of the designated play area 108. This freedom gives the player the ability to place Battle Pieces 104 on slanted Barrier Pieces 102, a formation that has strategic advantages. Battle Pieces 104 on a slant are easier to flick at a further range, giving the Battle Pieces 104 more mobility in a certain direction.

Figure 7:
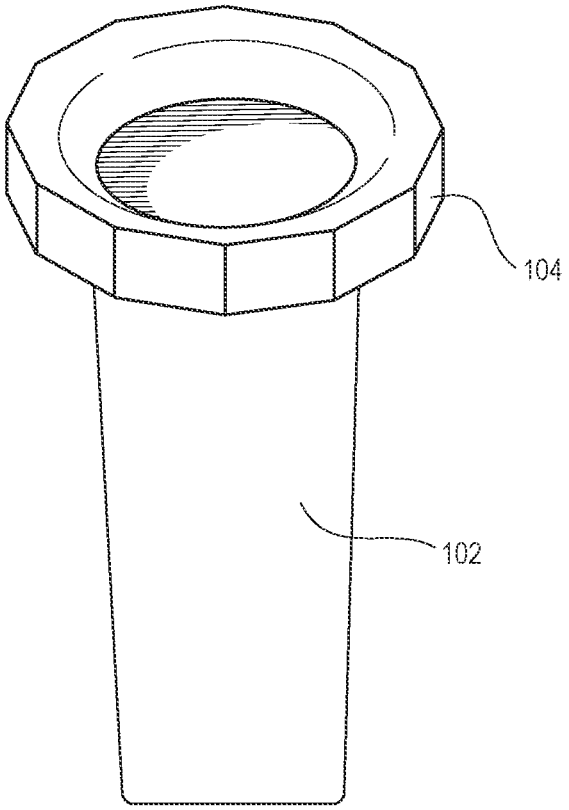
FIG. 7 illustrates another example game piece setup in accordance with various embodiments.

FIG. 7 illustrates another example game piece setup in accordance with various embodiments. Here, an example strategy setup called a "sniper tower" is illustrated. By placing a Battle Piece 104 on a vertically placed Barrier Piece 102 during the building phase, players give the Battle Piece 104 more range and the ability to hit elevated pieces. "Sniper towers" may have lower accuracy than cannons, but their Battle Pieces 104 can reach higher elevations.

Figure 8:
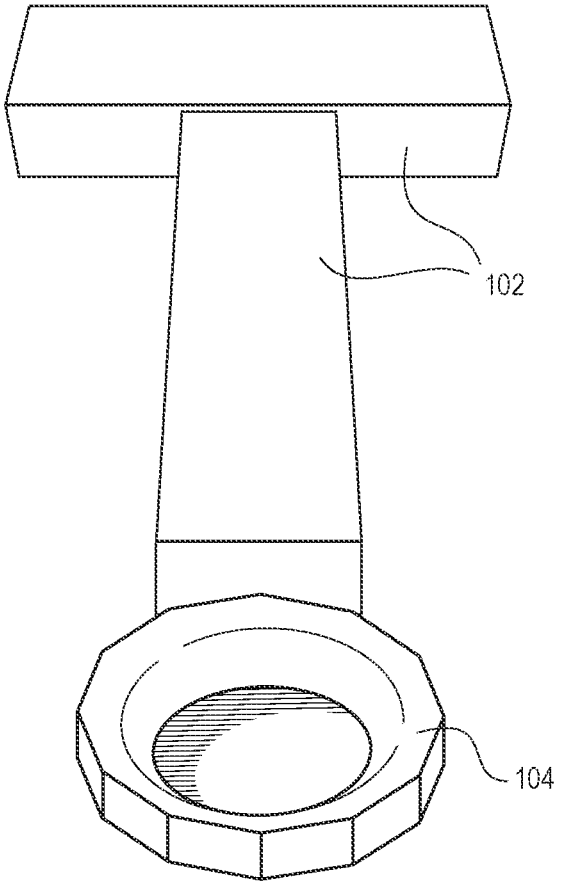
FIG. 8 illustrates another example game piece setup in accordance with various embodiments.

FIG. 8 illustrates another example game piece setup in accordance with various embodiments. Here, an example strategy setup called a "battleram" is illustrated. By placing pieces in a T formation, where one Barrier Piece 102 ends in the middle of the side of another Barrier Piece 102 and a Battle Piece 104 is placed on the other end of the first Barrier Piece 102, players can effectively flick Battle Pieces 104 into Barrier Pieces 102, sending Barrier Pieces 102 across the play area 108. This strategy can be used to topple the enemy base 112 by colliding Barrier Pieces 102 with enemy Barrier Pieces 102. Battlerams can also be used to knock enemy Battle Pieces 104 outside of the designated play area 108.

In various embodiments, after one player finishes building, they may declare it and may not alter their structure in any other way. After the first player declares their completion, the other player may have one minute (or another time limit) to finish building their base 112. After both players finish building or the time passes, the Building Phase ends and the Battle Phase begins.

During the Battle Phase, the players may take turns flicking Battle Pieces 104 of their color or their King Piece 106. In certain approaches, the player who finished building their base 112 first may flick first. A flick, as is commonly understood, may include one swift motion of the finger where the wrist does not move from its original position, and is one example manner to propel the Battle Piece 104 during the Battle Phase. Players preferably may flick to move their Battle Piece's position on the play area 108, to disrupt the enemy base 112 by knocking into enemy Barrier Pieces 102, or to eliminate enemy pieces (Barrier Pieces 102 or Battle Pieces 104). In certain examples, all Battle Pieces 104 of any opposing player that touches a Battle Piece 104 of the player whose turn it is may be eliminated and therefore removed from play. In certain examples, any Battle Piece 104 or Barrier Piece 102 that leaves the official play area 108 set by the players (in most games this means falling off the table or board) may be eliminated and removed from play. Battle Pieces 104 can leave the play area 108 by being flicked outside of the play area 108, or ricocheting off another piece. In certain examples, if a player knocks a Barrier Piece 102 into a Battle Piece 104, and that Battle Piece 104 leaves the play area 108, that Battle Piece 104 may be eliminated.

In accordance with various embodiments, the player whose King Piece 106 survives the longest without being eliminated is the official winner. King Pieces 106 preferably may be eliminated through the same means as Battle Pieces 104 (as discussed above). For example, if a King Piece 106 is touched by an enemy Battle Piece 104 during the turn of the enemy Battle Piece 104, the King Piece 106 may be eliminated. In another example, if the King Piece 106 leaves the designated play area 108, the King Piece 106 may be eliminated. In a game with more than two players, if a King Piece 106 is eliminated, that player may be eliminated and removed from play. In one approach, this means their Battle Pieces 104 and Barrier Pieces 102 may be eliminated and removed from play. If an enemy player's King Piece 106 is elevated or protected by blocks, it may be difficult to eliminate the enemy King Piece 106. In this situation, players may need to get creative. Players may knock their Battle Pieces 104 into the enemy blocks to try to knock the King Piece 106 off its elevation.

Players may also eliminate elevated pieces by flicking them onto the platform. In some examples, this might only happens if the shooting piece is elevated or when the player is using a strategy such as a "sniper tower" (see FIG. 7) or "cannon" (see FIG. 6).

If a player is unable to flick any of their Battle Pieces 104 or King Piece 106 because they are covered by Barrier Pieces 102, their turn may be skipped until any of their Battle Pieces 104 or their King Piece 106 are able to be flicked. This is one of the downsides of completely barricading a player's King Piece 106 in all directions. If a player runs out of non-barricaded Battle Pieces 104, they may have to wait for their opponent(s) to take their turns until one of their Battle Pieces 104 or King Piece 106 opens up to be flicked.

In various approaches, Barrier Battle sets can be made through injection molding using plastics, for example Acrylonitrile butadiene styrene (ABS). Barrier Pieces 102 may be hollow, and in one particular example, may weigh around 14 grams. Similarly, while Battle Pieces may also weigh around 14 grams. Barrier Battles sets can also be made through 3D printing using, for example, Polylactic Acid (PLA) plastic. Other methods and materials may be utilized in the construction of the game pieces, and may include, for example, other plastic types, metal, wood, resin, paper, cardboard, glass, rubber, or other commonly known materials. Other embodiments of the game are possible, and may include making a game where the Barrier Pieces 102 are in more or less of a number. The Barrier Pieces 102 can also come in different sizes and dimensions, as well as be different shapes such as cubes, triangular prisms, cylinders, or spherical or partially spherical shapes and other three dimensional shapes that are capable of being stacked or placed near each other to build a fort. The Battle Pieces 104 can also come in a larger or smaller quantity, and come in different shapes such as circles or polygonal shapes like pentagons or octagons. The game can also be played with sets of Barrier Pieces 102 and Battle Pieces 104 of a third or fourth color representing a third or fourth player. For example, a red team with a set amount of red Barrier Pieces 102 and Battle Pieces 104, a blue team with a set amount of blue Barrier Pieces 102 and Battle Pieces 104, and a green team with a set amount of green Barrier Pieces 102 and Battle Pieces 104. Even more colors can be used if additional players are desired. A game consisting of more than two teams may play out very similarly, where the players may go around taking turns by flicking pieces and can eliminate any piece of the other teams through collision. The player whose King Piece 106 survives the longest wins.

Barrier Battles preferably uses the method of flicking to propel the Battle Pieces 104 as the movement and attacking method for the Battle Pieces, though other methods may work as long as they have a possibility of error. For example, using a stick to move the pieces, such as one similar to pool or hockey, may work since the methods require aiming, and thus the pieces could move in a way unintended. Barrier Battles can also be played without the King Piece 106, wherein the player who loses all of their pieces first loses and the player whose last piece survives the longest wins. Another embodiment of the game is where pieces only get eliminated through falling out of bounds, wherein players must knock enemies' pieces off the play area 108 in order to garner eliminations. Optional playing rules also include adding a "tie-breaker mode" if multiple King Pieces 106 get eliminated at the same time by falling off the table. In this mode, players remove all Barrier Pieces 102 and Battle Pieces 104 from the game and place their King Pieces 106 at opposite ends of the play area 108. The players may then continue taking their turns and play out the game of Barrier Battles without any Barrier Pieces 102 or Battle Pieces 104.

Barrier Battles may also be played where the King Piece 106 is disguised as another Battle Piece 104. In this game mode, the King Piece's color and dimension may be identical to the Battle Pieces 104 with the exception that the King Piece 106 may have an identifiable feature not apparent without seeing its surface which is in contact with the surface of the play area 108. For example, a red Barrier Battles set could have five red Battle Pieces 104 and one red King Piece 106 with a small dot on its lower surface. When playing, only the player who controls the red team would know which one is his King Piece 106, and only after one of the player's pieces is eliminated would the opponent know if it was a King Piece 106 or Battle Piece 104.

Barrier Battles is a two or more player game played on a flat surface such as a table, floor, or board. The playing area may have a set amount of space or borders, and that space may be equally divided into halves, thirds or quadrants among the players. At the start of a game, each player places Barrier Pieces 102 of their chosen color, which are may be rectangular blocks, in different formations in the player's designated playing area. The Barrier Pieces 102 (see FIG. 4) can be placed next to each other or spread out, and can be placed on any one of their surfaces. The players may also place their Battle Pieces 104 (see FIG. 5), which may be circular discs, anywhere throughout their play area 108, including next to, on top of, or below Barrier Pieces 102 or other Battle Pieces 104. The players also may choose where to place their King Piece 106, which may be a piece of the same shape and dimensions of the Battle Pieces 104, but which may have a distinct color. In one example, once a player finishes building, all other players have up to 1 minute (or another time) after to finish building their bases 112.

After all players finish building, the Battle Phase begins. In one example, the player who finished building first will go first, and the turn order may be clockwise or counter-clockwise around the play area 108. A turn may consists of flicking or otherwise propelling a Battle Piece 104 or King Piece 106 of the player taking their turn. The Battle Piece 104 can be flicked in any direction, but if it goes outside the play area 108, it may be removed from the game and unable to come back into play. In accordance with various embodiments, a Battle Piece 104 that is flicked keeps its new position, and if it were to be flicked again, it must be flicked from its new position. A Battle Piece 104 can be flicked into a Barrier Piece 102 of any team, which can reform, move, or topple a base 112. If a Battle Piece 104 is flicked into a Battle Piece 104 of an enemy player, the enemy's Battle Piece 104 may be eliminated. If a Battle Piece 104 directly hits an enemy King Piece 106, the enemy may lose the game and must remove all their Barrier Pieces 102 and Battle Pieces 104 from play. A player who loses the game may no longer interact or play until the game is over. King Pieces 106 may be moved through the method of flicking just like Battle Pieces 104. Also, like Battle Pieces 104, the King Pieces 106 can interact with and move Barrier Pieces 102. King Pieces 106 may also eliminate enemy Battle Pieces 104 and King Pieces 106 through collision. King Pieces 106 may also be eliminated through the same methods as Battle Pieces 104. For example, if a King Piece 106 is touched by an enemy Battle Piece 104 during the enemy's turn, the King Piece 106, and therefore the player, is may be eliminated from the game.

In certain examples, there is no "friendly fire" in Barrier Battles. If a player flicks one of their Battle Pieces 104 into a friendly Battle Piece 104, the Battle Piece 104 may not be eliminated through collision alone. However, if a player hits a Battle Piece 104 into a friendly Battle Piece 104 or Barrier Piece 102 and that Battle Piece 104 or Barrier Piece 102 moves outside the play area 108, it is eliminated. In some approaches, during a player's turn, their Battle Pieces 104 may have superiority over enemy pieces. This means any enemy Battle Piece 104 that is touched by or touches a Battle Piece 104 of the player whose turn it is (and therefore has superiority) may be eliminated. As such, even if an enemy Battle Piece 104 touches a friendly Battle Piece 104 with superiority that was not flicked, the enemy Battle Piece 104 may be removed from play. If an enemy Battle Piece 104 falls on top of a Battle Piece 104 with superiority (because it belongs to a player whose turn it currently is), the enemy Battle Piece 104 may be removed from play.

In certain approaches, King Pieces 106 may act just like Battle Pieces 104. However, since an elimination of the King Piece 106 may lead to a loss of the game for that player, a player may desire to keep their King Pieces 106 in a defensive position if possible. The player whose King Piece 106 survives the longest is the winner.

In certain embodiments, because Barrier Pieces 102 may not be eliminated through collision unless knocked outside the player area, players may choose to surround or elevate their King Piece 106 or other pieces using Barrier Pieces 102. A potential flick a player has on an enemy Battle Piece 104 can be blocked by a Barrier Piece 102. However, if a player flicks a Battle Piece 104 into a Barrier Piece 102, that Barrier Piece 102 may knock other Battle Pieces 104 outside the play area 108 and therefore eliminate them. Though the base set of rules are simple, many strategies exist as a consequence of the basic set of rules. For example, players may put their Barrier Pieces 102 in a slant and put a Battle Piece 104 on top of it in a strategy unofficially called a "cannon" (see FIG. 6). In another example, players may place a single Battle Piece 104 on top of a vertical Barrier Piece 102 in a strategy unofficially called a "sniper tower" (see FIG. 7). In another example, players may place Barrier Battle Pieces 104 in front of Battle Pieces 104 in certain formations such as a T-shape in a strategy unofficially called a "battleram" (see FIG. 8). Players may win or lose with any number of Battle Pieces 104 or Barrier Pieces 102 left in the game. For example, in a two player game, if a player eliminates an enemy King Piece 106, the player may win even if the enemy had more Battle Pieces 104 or Barrier Pieces 102 in play than the winner. Though it is possible to win in this way, since Battle Pieces 104 provide great utility, it may be in both players' best interest to keep their Battle Pieces 104 in play and eliminate enemy Battle Pieces 104. Some strategies, however, may rely on sacrificing Battle Pieces 104 in an attempt to eliminate the enemy King Piece 106. Some players' play style may waste many Battle Pieces 104, missing hard shots on the King Piece 106 in an attempt to win the game.

Some players may play more conservatively and garner eliminations before trying to eliminate the enemy King Piece 106. Like building their base 112, the players preferably chose how they approach eliminating the enemy King Piece 106.

In accordance with the foregoing, a method of playing a game in accordance with various embodiments comprises providing two or more sets Barrier Pieces 102; constructing a separate barrier with each of said two or more Barrier Pieces 102; providing two or more sets of Battle Pieces 104; placing said two or more sets of more Battle Pieces 104 in positions for play; flicking a first Battle Piece 104 from the first set of said Battle Pieces 104 to a new position; and flicking a first Battle Piece 104 from the second set of said Battle Pieces 104 to a new position.

In other approaches, and in accordance with the foregoing, a method of playing a game may include commencing a building phase, which may include placing a plurality of first player Barrier Pieces 102, a plurality of first player Battle Pieces 104, and at least one first player King Piece 106 in a first player fortress arrangement, and placing a plurality of second player Barrier Pieces 102, a plurality of second player Battle Pieces 104, and at least one second player King Piece 106 in a second player fortress arrangement separate from the first player fortress arrangement.

Further, the method may include commencing a battle phase following the building phase. The battle phase may include propelling a first first player Battle Piece 104 toward the second player fortress arrangement; contacting, by the first first player Battle Piece 104, the at least one second player King Piece 106; eliminating the second player King Piece 106 in response to being contacted by the first first player Battle Piece 104; and ending the game and declaring the first player as a winner of the game.

The method may further include propelling a second first player Battle Piece 104 toward the second player fortress arrangement; contacting, by the second first player Battle Piece 104, at least one second player Battle Piece 104; and eliminating by removing from the game the second player Battle Piece 104 in response to being contacted by the second first player Battle Piece 104. In other examples, the method may further include propelling the at least one first player King Piece 106 toward the second player fortress arrangement; contacting, by the at least one first player King Piece 106, at least one second player Battle Piece 104; and eliminating by removing from the game the second player Battle Piece 104 in response to being contacted by the at least one first player King Piece 106.

In certain examples, the method may include, during the building phase, declaring, by the first player, completion of the first player fortress arrangement; allowing a preset time to elapse after the first player declares completion of the first player fortress arrangement; completing, by the second player, the second player fortress arrangement; and ending the building phase after the preset time elapses.

In some examples, the method may also include, during a first turn, propelling a second first player Battle Piece 104 toward the second player fortress arrangement, wherein the second first player Battle Piece 104 comes to rest at a first resting location; and during a second turn subsequent to the first turn, propelling the second first player Battle Piece 104 toward the second player fortress arrangement from the first resting location. Similarly, the method may include, during a first turn, propelling the at least one first player King Piece 106 toward the second player fortress arrangement, wherein the at least one first player King Piece 106 comes to rest at a first resting location; and during a second turn subsequent to the first turn, propelling the at least one first player King Piece 106 toward the second player fortress arrangement from the first resting location.

In certain examples, the at least one first player King Piece 106 may be disguised as a first player Barrier Piece 102 and includes a first hidden designator, and the at least one second player King Piece 106 may be disguised as a second player Barrier Piece 102 and includes a second hidden designator.

In certain examples, the method also includes, prior to commencing the building phase, determining a boundary 110 defining an area of play 108. Then, during the battle phase, the method includes causing at least one of the plurality of first player Barrier Pieces 102, the plurality of first player Battle Pieces 104, the at least one first player King Piece 106, the plurality of second player Barrier Pieces 102, the plurality of second player Battle Pieces 104, or the at least one second player King Piece 106 to exit the area of play 108; and eliminating from the game the at least one of the plurality of first player Barrier Pieces 102, the plurality of first player Battle Pieces 104, the at least one first player King Piece 106, the plurality of second player Barrier Pieces 102, the plurality of second player Battle Pieces 104, or the at least one second player King Piece 106 that exited the area of play 108. Similarly, during the building phase, the method may also include placing the plurality of first player Barrier Pieces 102, the plurality of first player Battle Pieces 104, and the at least one first player King Piece 106 in the first player fortress arrangement within the area of play 108; and placing the plurality of second player Barrier Pieces 102, the plurality of second player Battle Pieces 104, and the at least one second player King Piece 106 in the second player fortress arrangement within the area of play 108.

Also in accordance with the foregoing, and in accordance with various embodiments (which may or may not overlap with the preceding method) a slightly different method for playing a game includes determining a boundary 110 defining an area of play 108, and then commencing a building phase. The building phase may include placing a plurality of first player Barrier Pieces 102 and a plurality of first player Battle Pieces 104 in a first player fortress arrangement within a first portion of the area of play 108, and placing a plurality of second player Barrier Pieces 102 and a plurality of second player Battle Pieces 104 in a second player fortress arrangement within a second portion of the area of play 108 separate from the first portion of the area of play 108. The method also includes subsequently commencing a battle phase following the building phase. The battle phase may include propelling a first first player Battle Piece toward the second player fortress arrangement; impacting, by the first first player Battle Piece, at least one of a first second player Battle Piece or a first second player Barrier Piece; causing at least one of the plurality of second player Barrier Pieces or the plurality of second player Battle Pieces to exit the area of play 108; and eliminating from the game the at least one of the plurality of second player Barrier Pieces or the plurality of second player Battle Pieces that exited the area of play 108.

In various approaches, the method also includes causing all of the plurality of second player Battle Pieces 104 to exit the area of play 108, and responsively ending the game and declaring the first player as a winner of the game. The method may also include propelling a second first player Battle Piece toward the second player fortress arrangement; impacting, by the second first player Battle Piece, a second second player Battle Piece; and eliminating by removing from the game the second second player Battle Piece in response to being contacted by the second first player Battle Piece.

In certain examples, the method may include, during the building phase, declaring, by the first player, completion of the first player fortress arrangement; allowing a preset time to elapse after the first player declares completion of the first player fortress arrangement; completing, by the second player, the second player fortress arrangement; and ending the building phase after the preset time elapses.

In some approaches, the method may further include, during a first turn, propelling a second first player Battle Piece toward the second player fortress arrangement, wherein the second first player Battle Piece comes to rest at a first resting location, and during a second turn subsequent to the first turn, propelling the second first player Battle Piece toward the second player fortress arrangement from the first resting location.

Additionally, in various embodiments, the method may include, during the building phase, placing at least one first player King Piece in the first player fortress arrangement within the first portion of the area of play 108, and placing at least one second player King Piece in the second player fortress arrangement within the second portion of the area of play 108. Thereafter, the method may include, during the battle phase, propelling a second first player Battle Piece toward the second player fortress arrangement; contacting, by the second first player Battle Piece, the at least one second player King Piece; eliminating from the game the second player King Piece in response to being contacted by the second first player Battle Piece; and ending the game and declaring the first player as a winner of the game.

Similarly, the method may include, during the battle phase, propelling a second first player Battle Piece toward the second player fortress arrangement; causing the at least one second player King Piece to exit the area of play 108; eliminating from the game the at least one second player King Piece that exited the area of play 108; and ending the game and declaring the first player as a winner of the game. Similarly still, the method may also include, during the battle phase, propelling the at least one first player King Piece toward the second player fortress arrangement; contacting, by the at least one first player King Piece, at least one second player Battle Piece; and eliminating by removing from the game the second player Battle Piece in response to being contacted by the at least one first player King Piece. Similarly still, the method may also include, during the battle phase, during a first turn, propelling the at least one first player King Piece toward the second player fortress arrangement, wherein the at least one first player King Piece comes to rest at a first resting location; and during a second turn subsequent to the first turn, propelling the at least one first player King Piece toward the second player fortress arrangement from the first resting location.

In various approaches, the method may also include providing the plurality of first player Barrier Pieces comprising 15 first player Barrier Pieces; providing the plurality of first player Battle Pieces comprising five first player Battle Pieces; providing the plurality of second player Barrier Pieces comprising 15 second player Barrier Pieces; and providing the plurality of second player Battle Pieces comprising five second player Battle Pieces.

Additionally, in accordance with the foregoing, in various embodiments, a set for playing a game may include: a first set of one or more Barrier Pieces 102 wherein each of said one or more Barrier Pieces 102 has at least one substantially flat side; a second set of one or more Barrier Pieces 102 wherein each of said one or more Barrier Pieces 102 has at least one substantially flat side; a first set of one or more Battle Pieces 104 corresponding to the first set of one or more Barrier Pieces 102; a second set of one or more Battle Pieces 104 corresponding to the second set of one or more Barrier Pieces 102; a first flag piece (e.g., King Piece 106) corresponding to the first set of one or more Barrier Pieces 102 or the first set of one or more Battle Pieces 104; and a second flag piece corresponding to the second set of one or more Barrier Pieces 102 or the second set of one or more Battle Pieces 104.

Additionally, in accordance with the foregoing, in various embodiments, a set for playing a game may include: a first set of one or more Barrier Pieces 102 wherein each of said one or more Barrier Pieces 102 has at least one substantially flat side; a second set of one or more Barrier Pieces 102 wherein each of said one or more Barrier Pieces 102 has at least one substantially flat side; a first set of one or more Battle Pieces 104 corresponding to the first set of one or more Barrier Pieces 102; a second set of one or more Battle Pieces 104 corresponding to the second set of one or more Barrier Pieces 102; a first flag piece (e.g., King Piece 106) corresponding to the first set of one or more Barrier Pieces 102 or the first set of one or more Battle Pieces 104; and a second flag piece corresponding to the second set of one or more Barrier Pieces 102 or the second set of one or more Battle Pieces 104.

Similarly, in accordance with the foregoing, in various embodiments, a kit for playing a game may include: a plurality of first player Barrier Pieces 102, wherein each of the plurality of first player Barrier Pieces 102 has at least one substantially flat side configured to contact a playing surface; a plurality of first player Battle Pieces 104, wherein each of the plurality of first player Battle Pieces 104 is circular and configured to slide on the playing surface; at least one first player King Piece 106; a plurality of second player Barrier Pieces 102, wherein each of the plurality of second player Barrier Pieces 102 has at least one substantially flat side configured to contact the playing surface; a plurality of second player Battle Pieces 104, wherein each of the plurality of second player Battle Pieces 104 is circular and configured to slide on the playing surface; and at least one second player King Piece 106. In this kit, the plurality of first player Barrier Pieces 102 and the plurality of first player Battle Pieces 104 may be a first color, the plurality of second player Barrier Pieces 102 and the plurality of second player Battle Pieces 104 may be a second color different from the first color, the at least one first player King Piece 106 may be a third color different from the first color and the second color, and the at least one second player King Piece 106 may be a fourth color different from the first color, the second color, and the third color.

Although the subject matter has been described in language specific to structural features and/or methodological acts, it is to be understood that the subject matter defined in the appended claims is not necessarily limited to the specific features or acts described. Rather, the specific features and acts are disclosed as illustrative forms of implementing the claims. One skilled in the art will realize that a virtually unlimited number of variations to the above descriptions are possible, and that the examples and the accompanying figures are merely to illustrate one or more examples of implementations. It will be understood by those skilled in the art that various other modifications can be made, and equivalents can be substituted, without departing from claimed subject matter. Additionally, many modifications can be made to adapt a particular situation to the teachings of claimed subject matter without departing from the central concept described herein. Therefore, it is intended that claimed subject matter not be limited to the particular embodiments disclosed, but that such claimed subject matter can also include all embodiments falling within the scope of the appended claims, and equivalents thereof.

In the detailed description above, numerous specific details are set forth to provide a thorough understanding of claimed subject matter. However, it will be understood by those skilled in the art that claimed subject matter can be practiced without these specific details.

In other instances, methods, devices, or systems that would be known by one of ordinary skill have not been described in detail so as not to obscure claimed subject matter.

Various implementations have been specifically described. However, many other implementations are also possible.

What is claimed is:

1. A method of playing a game, the method comprising: commencing a building phase comprising:

placing a plurality of first player barrier pieces, a plurality of first player battle pieces, and at least one first player king piece in a first player fortress arrangement;

placing a plurality of second player barrier pieces, a plurality of second player battle pieces, and at least one second player king piece in a second player fortress arrangement separate from the first player fortress arrangement;

commencing a battle phase following the building phase, the battle phase comprising:

propelling a first first player battle piece toward the second player fortress arrangement;

contacting, by the first first player battle piece, the at least one second player king piece;

eliminating the second player king piece in response to being contacted by the first first player battle piece; and ending the game and declaring the first player as a winner of the game.

2. The method of playing a game according to claim 1, further comprising:

propelling a second first player battle piece toward the second player fortress arrangement;

contacting, by the second first player battle piece, at least one second player battle piece; and eliminating by removing from the game the second player battle piece in response to being contacted by the second first player battle piece.

3. The method of playing a game according to claim 1, further comprising:

propelling the at least one first player king piece toward the second player fortress arrangement;

contacting, by the at least one first player king piece, at least one second player battle piece; and eliminating by removing from the game the second player battle piece in response to being contacted by the at least one first player king piece.

4. The method of playing a game according to claim 1, further comprising:

during the building phase:

declaring, by the first player, completion of the first player fortress arrangement;

allowing a preset time to elapse after the first player declares completion of the first player fortress arrangement;

completing, by the second player, the second player fortress arrangement; and ending the building phase after the preset time elapses.

5. The method of playing a game according to claim 1, further comprising:

during a first turn, propelling a second first player battle piece toward the second player fortress arrangement, wherein the second first player battle piece comes to rest at a first resting location; and during a second turn subsequent to the first turn, propelling the second first player battle piece toward the second player fortress arrangement from the first resting location.

6. The method of playing a game according to claim 1, further comprising:

during a first turn, propelling the at least one first player king piece toward the second player fortress arrangement, wherein the at least one first player king piece comes to rest at a first resting location; and during a second turn subsequent to the first turn, propelling the at least one first player king piece toward the second player fortress arrangement from the first resting location.

7. The method of playing a game according to claim 1, wherein the at least one first player king piece is disguised as a first player barrier piece and includes a first hidden designator, and wherein the at least one second player king piece is disguised as a second player barrier piece and includes a second hidden designator.

8. The method of playing a game according to claim 1, further comprising:

prior to commencing the building phase, determining a boundary defining an area of play; and during the battle phase:

causing at least one of the plurality of first player barrier pieces, the plurality of first player battle pieces, the at least one first player king piece, the plurality of second player barrier pieces, the plurality of second player battle pieces, or the at least one second player king piece to exit the area of play; and eliminating from the game the at least one of the plurality of first player barrier pieces, the plurality of first player battle pieces, the at least one first player king piece, the plurality of second player barrier pieces, the plurality of second player battle pieces, or the at least one second player king piece that exited the area of play.

9. The method of playing a game according to claim 1, further comprising:

prior to commencing the building phase, determining a boundary defining an area of play; and during the building phase:

placing the plurality of first player barrier pieces, the plurality of first player battle pieces, and the at least one first player king piece in the first player fortress arrangement within the area of play; and placing the plurality of second player barrier pieces, the plurality of second player battle pieces, and the at least one second player king piece in the second player fortress arrangement within the area of play.

10. A method of playing a game, the method comprising:

determining a boundary defining an area of play;

commencing a building phase comprising:

placing a plurality of first player barrier pieces and a plurality of first player battle pieces in a first player fortress arrangement within a first portion of the area of play;

placing a plurality of second player barrier pieces and a plurality of second player battle pieces in a second player fortress arrangement within a second portion of the area of play separate from the first portion of the area of play;

commencing a battle phase following the building phase, the battle phase comprising:

propelling a first first player battle piece toward the second player fortress arrangement;

impacting, by the first first player battle piece, at least one of a first second player battle piece or a first second player barrier piece;

causing at least one of the plurality of second player barrier pieces or the plurality of second player battle pieces to exit the area of play; and eliminating from the game the at least one of the plurality of second player barrier pieces or the plurality of second player battle pieces that exited the area of play.

11. The method of playing a game according to claim 10, further comprising:

causing all of the plurality of second player battle pieces to exit the area of play; and ending the game and declaring the first player as a winner of the game.

12. The method of playing a game according to claim 10, further comprising:

propelling a second first player battle piece toward the second player fortress arrangement;

impacting, by the second first player battle piece, a second second player battle piece; and eliminating by removing from the game the second second player battle piece in response to being contacted by the second first player battle piece.

13. The method of playing a game according to claim 10, further comprising:

during the building phase:

declaring, by the first player, completion of the first player fortress arrangement;

allowing a preset time to elapse after the first player declares completion of the first player fortress arrangement;

completing, by the second player, the second player fortress arrangement; and ending the building phase after the preset time elapses.

14. The method of playing a game according to claim 10, further comprising:

during a first turn, propelling a second first player battle piece toward the second player fortress arrangement, wherein the second first player battle piece comes to rest at a first resting location; and during a second turn subsequent to the first turn, propelling the second first player battle piece toward the second player fortress arrangement from the first resting location.

15. The method of playing a game according to claim 10, further comprising:

during the building phase:

placing at least one first player king piece in the first player fortress arrangement within the first portion of the area of play; and placing at least one second player king piece in the second player fortress arrangement within the second portion of the area of play; and during the battle phase:

propelling a second first player battle piece toward the second player fortress arrangement;

contacting, by the second first player battle piece, the at least one second player king piece;

eliminating from the game the second player king piece in response to being contacted by the second first player battle piece; and ending the game and declaring the first player as a winner of the game.

16. The method of playing a game according to claim 10, further comprising:

during the building phase:

placing at least one first player king piece in the first player fortress arrangement within the first portion of the area of play; and placing at least one second player king piece in the second player fortress arrangement within the second portion of the area of play; and during the battle phase:

propelling a second first player battle piece toward the second player fortress arrangement;

causing the at least one second player king piece to exit the area of play;

eliminating from the game the at least one second player king piece that exited the area of play; and ending the game and declaring the first player as a winner of the game.

17. The method of playing a game according to claim 10, further comprising:

during the building phase:

placing at least one first player king piece in the first player fortress arrangement within the first portion of the area of play; and placing at least one second player king piece in the second player fortress arrangement within the second portion of the area of play; and during the battle phase:

propelling the at least one first player king piece toward the second player fortress arrangement;

contacting, by the at least one first player king piece, at least one second player battle piece; and eliminating by removing from the game the second player battle piece in response to being contacted by the at least one first player king piece.

18. The method of playing a game according to claim 10, further comprising:

during the building phase:

placing at least one first player king piece in the first player fortress arrangement within the first portion of the area of play; and placing at least one second player king piece in the second player fortress arrangement within the second portion of the area of play; and during the battle phase:

during a first turn, propelling the at least one first player king piece toward the second player fortress arrangement, wherein the at least one first player king piece comes to rest at a first resting location; and during a second turn subsequent to the first turn, propelling the at least one first player king piece toward the second player fortress arrangement from the first resting location.

19. The method of playing a game according to claim 10, further comprising:

providing the plurality of first player barrier pieces comprising 15 first player barrier pieces;

providing the plurality of first player battle pieces comprising five first player battle pieces;

providing the plurality of second player barrier pieces comprising 15 second player barrier pieces; and providing the plurality of second player battle pieces comprising five second player battle pieces.

* * * * *